US005565055A

United States Patent [19]

Croci

[11] Patent Number: 5,565,055

[45] Date of Patent: Oct. 15, 1996

[54] DECORATION OF ARTICLES

[75] Inventor: Paul C. Croci, Southboro, Mass.

[73] Assignee: Avery Dennison Corporation, Pasadena, Calif.

[21] Appl. No.: 437,186

[22] Filed: May 8, 1995

[51] Int. Cl.[6] ..... B65C 9/04; B65C 9/06; B65C 9/18

[52] U.S. Cl. ..... 156/238; 156/240; 156/448; 156/540; 156/567; 156/DIG. 26

[58] Field of Search ..... 156/238, 240, 156/446, 448, 449, 540, 541, 542, 566, 567

[56] References Cited

U.S. PATENT DOCUMENTS

| | | | |
|---|---|---|---|
| 3,540,968 | 11/1970 | White | 156/475 |
| 4,203,798 | 5/1980 | Yamashita | 156/567 |
| 4,636,278 | 1/1987 | Wesley | 156/446 |
| 4,732,641 | 3/1988 | Nechay et al. | 156/448 |
| 4,806,197 | 2/1989 | Harvey | 156/449 |
| 4,992,129 | 2/1991 | Sasaki et al. | 156/240 |
| 5,047,107 | 9/1991 | Keller et al. | 156/184 |
| 5,121,827 | 6/1992 | Ribordy | 198/377 |
| 5,188,696 | 2/1993 | Good, Jr. | 156/361 |
| 5,290,388 | 3/1994 | Zepf | 156/447 |

FOREIGN PATENT DOCUMENTS 9405515 3/1994 WIPO .

*Primary Examiner*—Esther Kepplinger
*Assistant Examiner*—Curtis E. Scherrer
*Attorney, Agent, or Firm*—Kriegsman & Kriegsman

[57] ABSTRACT

Method and system for decorating a round, oval or irregularly-shaped, open-ended article with a heat-transfer, wrap-around label supported on a carrier web. The system comprises a turret for positioning the open-ended article at a transfer location. The turret comprises a continuously rotating mandrel and a motor, the motor being coupled to the mandrel for continuously driving the rotation of the mandrel. The rotating mandrel is appropriately sized and shaped to be inserted into the open-ended article through the open end thereof and to follow the circumferential contour of the interior surface of the open-ended article when the open-ended article engages and rolls about the rotating mandrel. The system also includes a feed mechanism for positioning the label on the carrier web at the transfer location, the surface speed of the web matching that of the rotating mandrel. The system further includes means for transferring a label from the carrier web to the exterior of the open-ended article, the label, during transfer, pressing the interior surface of the open-ended article into engagement with the rotating mandrel in such a way as to cause the open-ended article to engage and roll about the rotating mandrel. In this manner, the surface speed of the article at any given cross-section thereof is kept constant and can be matched to the surface speed of the carrier web. The system further includes conveyor means for feeding the open-ended article to the turret before labelling and for removing the open-ended article from the turret after labelling.

17 Claims, 5 Drawing Sheets

DECORATION OF ARTICLES

BACKGROUND OF THE INVENTION

The present invention relates generally to the decoration of articles and more particularly to the decoration of articles using heat-transfer labels.

Decorating systems using heat-transfer labels have received widespread commercial use over the last several years. Typically, such decorating systems comprise a transfer mechanism for transferring a label from a continuous carrier web onto a desired article at a transfer location, a turret for sequentially positioning articles at the transfer location, a feed mechanism for sequentially positioning labels on the carrier web at the transfer location, and conveyors for feeding articles to the turret before labelling and for removing articles from the turret after labelling.

In commonly-assigned PCT Application No. PCT/US93/08191, which was published Mar. 17, 1994, and which is incorporated herein by reference, several embodiments of an apparatus for applying heat-transfer labels to containers from a carrier web are disclosed. According to a first embodiment, the apparatus is intended for applying "wrap-around" (i.e., circumferentially extending) labels to round, non-tapered containers and comprises a continuously rotating turret, a container transport system for continuously delivering containers to and away from the turret and a web transport system for moving a web containing heat-transfer labels into positioning for label transferring. The turret includes a rotatably driven shaft and a plurality of cup assemblies arranged in a circle around the shaft and coupled thereto. Each cup assembly includes a cup used to hold a container, the cup being rotatably driven independently of the shaft and in a required direction. A nozzle assembly is associated with each cup assembly and is used to secure a container within its respective cup and, if necessary, to inflate the container to impart sufficient rigidity thereto for labelling. Each cup assembly and its associated nozzle assembly together define a container holding station. The turret also includes a plurality of transfer assemblies arranged in a circle around the shaft and spaced radially inwardly from the container holder stations, each transfer assembly being associated with a corresponding container holding station. Each transfer assembly includes a heater/platen and a transfer roller. The heater/platen is mounted on a cam follower which is adapted to ride along a cam rail. The cam rail is of an appropriate length so that two or more cam followers may be riding therealong at one time. Each transfer roller is connected to its associated heater/platen in such a way that, when the cam follower is not riding along the cam rail, the transfer roller is urged radially outwardly in such a way as to transfer a label from the web onto a container.

Although decorating systems of the type described above perform reasonably well when used to apply wrap-around labels to round, non-tapered containers, such systems typically cannot be used to apply such labels to oval-shaped containers (such as those commonly used to dispense solid antiperspirant or deodorant sticks) due to a phenomenon commonly referred to in the art as "label distortion." Label distortion, the undesired stretching or shrinking of a label applied to an article, typically occurs when the surface speed of the article being decorated with a label does not match the surface speed of the carrier web supporting the label. In other words, where the surface speed of the article exceeds that of the carrier web, the label stretches when applied to the article; conversely, where the surface speed of the web exceeds that of the article, the label shrinks when applied to the article. Label distortion is not typically a problem for cylindrically-shaped articles because, when cylindrically-shaped articles are rotated at a constant angular velocity, the surface speed is also constant. By contrast, oval and other irregularly-shaped articles rotated at a constant angular velocity have significant variations in surface speed. For example, the speed of a particular point on the surface of an oval-shaped article is dependent on its distance from the axis of rotation of the article. Points further from the axis have a higher speed than points closer to the axis. Therefore, as can readily be appreciated, the speed differential can be substantial for various points along the surface of an oval-shaped article.

As a result of the above-described problem, oval-shaped containers have traditionally not been decorated with wrap-around labels, but rather, have been limited to being decorated by applying a first label of limited size to the front of the container and a second label of limited size to the back of the container. As can readily be appreciated, such small labels can be highly undesirable from an advertising or similar perspective. Moreover, the aforementioned technique typically requires the use of two turrets, the first turret being used to position the container for receipt of the first label and the second turret being used to position the container for receipt of the second label, as well as means for turning the container 180 degrees between the two turrets.

Recently, however, some decorating systems have been devised for use in applying wrap-around labels to oval-shaped containers. An example of such a system is described in U.S. Pat. No. 4,855,005, inventor Jodrey, which issued Aug. 8, 1989, and which is incorporated herein by reference. In the aforementioned patent, a decorating system is disclosed which comprises a compensated web transport arrangement in which the motion of the web is matched to that of the article being decorated. This is achieved, in accordance with one aspect of the invention, using a movable non-rotating cam and a cam follower wherein the cam follower is rigidly attached to a roller in the web transport path. The cam profile is designed to alter the speed of the web during transfer of the label to a particularly shaped article. The cam is linearly displaced by a reciprocating label shuttle bracket. The label shuttle normally accelerates the web for label transfer then decelerates the web after label transfer to permit closer spacing of labels on the carrier web. As the shuttle moves during the label transfer interval, the cam, mounted on the shuttle, displaces a roller. This roller in turn either retards or accelerates the web further so that the speed of the label receptive surface more closely approximates the speed of the web at all times during the label transfer interval.

According to a further aspect of the invention described in the aforementioned patent, the cam is designed to match a specific irregular surface. The more the shape of the article to be labelled deviates from a cylinder, the greater the web velocity correction necessary to reduce or avoid distortion. The cam profile is determined by first labelling the article by heat transfer with a pattern, normally consisting of evenly spaced vertical lines. An additional piece of the same pattern is then attached adjacent the labelled pattern so that the lines of both patterns are parallel. The distances between the correlated vertical lines of the two patterns are then measured along the boundary between patterns, perpendicular to the vertical lines. These distances indicate the amount of distortion of the label due to the web/container velocity differential at intervals on the article and are used in formulating the cam profile.

Another example of a decorating system adapted for applying wrap-around heat-transfer labels to oval-shaped containers is described in U.S. Pat. No. 4,300,974, inventor Bauer, which issued Nov. 17, 1981 and which is incorporated herein by reference. The decorating system of the aforementioned patent is adaptable to a variety of article cross-sections and is designed to ensure that the article and carrier web are moving at the same linear velocity while in contact. This is achieved by providing a cup which is connected to a rotatable cam, the article to be decorated being mounted in the cup. The article, cup and cam are all coaxially mounted, and the cam has an identical horizontal cross-section to that of the article to be labelled. The cam and the article are angularly oriented in phase synchronization. Preferably, the system includes means to preorient the article prior to depositing it in the cup. The cam contacts a cam follower, the latter being coaxially mounted with the transfer roll. The rotation of the cam is controlled by a flexible elongate member. Preferably, the flexible elongate member lies in the contact plane of the cam and cam follower. The flexible elongate member moves at the same linear velocity as the carrier web. The flexible elongate member comprises a cable.

As can readily be appreciated, the above-described systems for decorating oval and other irregularly-shaped containers are very complicated in both construction and operation, requiring the use of elaborate camming systems.

Other patents of interest include U.S. Pat. No. 3,540,968, inventor White, which issued Nov. 17, 1970, and U.S. Pat. No. 5,188,696, inventor Good, Jr., which issued Feb. 23, 1993, both of which are incorporated herein by reference.

SUMMARY OF THE INVENTION

It is an object of the present invention to provide a novel method and system for decorating articles.

It is another object of the present invention to provide a method and system as described above that can be used to decorate open-ended articles, be they round, oval or irregularly-shaped. For purposes of the present specification and claims, an "open-ended" article is an elongated article which has an open end and which does not have a neck extending from said open end which is substantially more narrow than the remainder of the article. In other words, an "open-ended article," as contemplated by the present invention, does not generally encompass a narrow-necked bottle. An "open-ended" article, as contemplated by the present invention, is preferably straight in cross-section but is not limited thereto. An example of an "open-ended" article is shown in FIGS. 1 through 4 herein.

It is yet another object of the present invention to provide a method and system as described above that overcomes at least some of the drawbacks associated with existing methods and systems for decorating oval and irregularly-shaped articles.

It is still yet another object of the present invention to provide a method and system as described above that requires the use of a minimal number of moving parts.

Additional objects, as well as features and advantages, of the present invention will be set forth in part in the detailed description which follows, and in part will be obvious from the detailed description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

In furtherance of the above and other objects to be described or to become apparent below, there is hereinafter provided a method for decorating an open-ended article with a label supported on a moving carrier web, said method comprising the steps of: (a) providing a rotatable mandrel, said rotatable mandrel being appropriately sized and shaped to be inserted into the open-ended article through the open end thereof and to follow the circumferential contour of the interior surface of the open-ended article when the open-ended article is rolled about said rotatable mandrel; (b) inserting said rotatable mandrel through the open end of the open-ended article; and (c) transferring a label from the moving carrier web to the exterior of the open-ended article, the label, during transfer, pressing the interior surface of the open-ended article into engagement with said rotatable mandrel in such a way as to cause the open-ended article to roll about the rotatable mandrel.

One particularly advantageous aspect of the above-described method is that the surface speed of the open-ended article is kept constant around the exterior surface of the article at any given cross-section thereof, regardless of the shape of the open-ended article. Consequently, the present method may be used to apply wrap-around labels (e.g., heat-transfer, pressure-sensitive, etc.) to oval and irregularly-shaped articles, as well as to round articles.

Another particularly advantageous aspect of the above-described method is that thin-walled or soft-walled articles, as well as more rigid-walled articles, can safely be decorated by the present method without being damaged by the application of pressure to the article during labelling. This is because the rotatable mandrel provides support to the article while the label is being applied thereto.

The present invention is also directed to a system for decorating an open-ended article with a label supported on a carrier web. Said system comprises a turret for positioning the open-ended article at a transfer location, said turret comprising a rotatable mandrel. The rotatable mandrel is appropriately sized and shaped to be inserted into the open-ended article through the open end thereof and to follow the contour of the interior surface of the open-ended article when the open-ended article is rolled about said rotatable mandrel. The system also includes a feed mechanism for moving the carrier web so as to position the label on the carrier web at the transfer location. The system further includes means for transferring a label from the carrier web to the exterior of the open-ended article, the label, during transfer, pressing the interior surface of the open-ended article into engagement with said rotatable mandrel in such a way as to cause the open-ended article to roll about the rotatable mandrel. The system further includes conveyor means for feeding the open-ended article to the turret before labelling and for removing the open-ended article from the turret after labelling.

According to a preferred embodiment, the turret also includes a platform onto which unlabelled articles are loaded and from which labelled articles are unloaded. Articles are sequentially labelled on the platform at a labelling location. A small opening is provided in the platform at the labelling location so that, when an article is positioned over the opening at the labelling location, the rotatable mandrel may be inserted up through the opening in the platform and into the article. An air cylinder is used to drive the mandrel up and down through the opening in the platform, and a motor, coupled to the mandrel by a belt, is used to continuously rotate the mandrel so that the surface speed of the mandrel matches that of the carrier web during labelling.

The turret also includes a rotatable central shaft which extends transversely through the platform. Rotation of the central shaft is driven by a rack and pinion. A pair of parallel starwheels, which are used to transport articles, one at time, to and away from the labelling location, are fixedly mounted on the central shaft. The turret further includes registration means for properly orienting the article at the labelling location immediately before labelling. In the present embodiment, said registration means includes a cam-driven finger element for releasably engaging the back face of the article and a pneumatic guide for releasably engaging the front face of the article.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
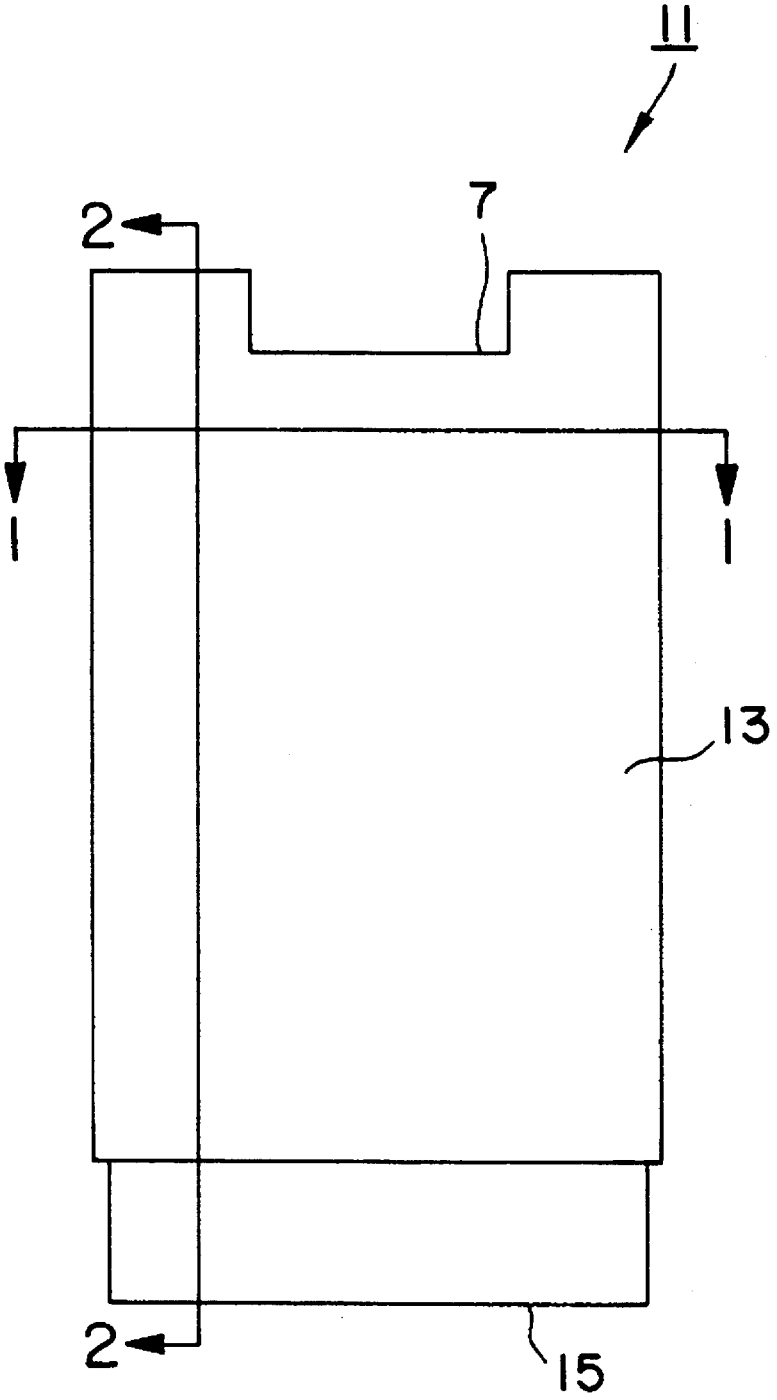
FIG. 1 is a front view of an illustrative example of an open-ended article which may be decorated in accordance with the teachings of the present invention.
Figure 2:
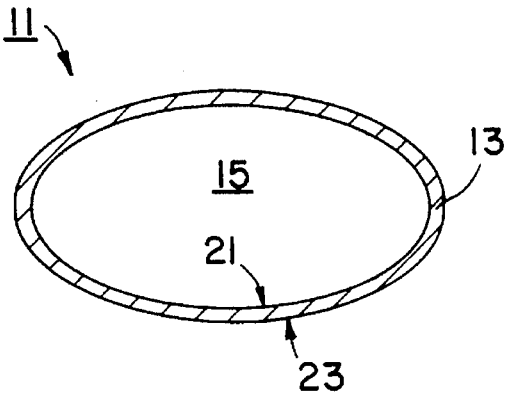
FIG. 2 is a section view of the open-ended article of FIG. 1 taken along line 1—1.
Figure 3:
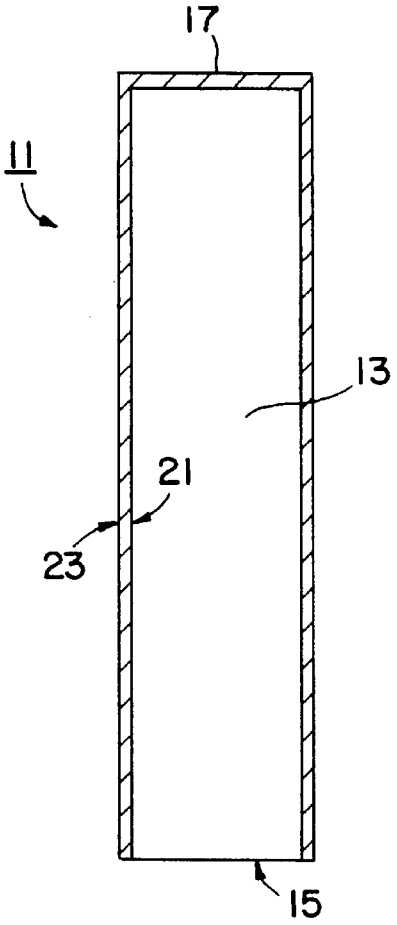
FIG. 3 is a section view of the open-ended article of FIG. 1 taken along line 2—2.
Figure 4:
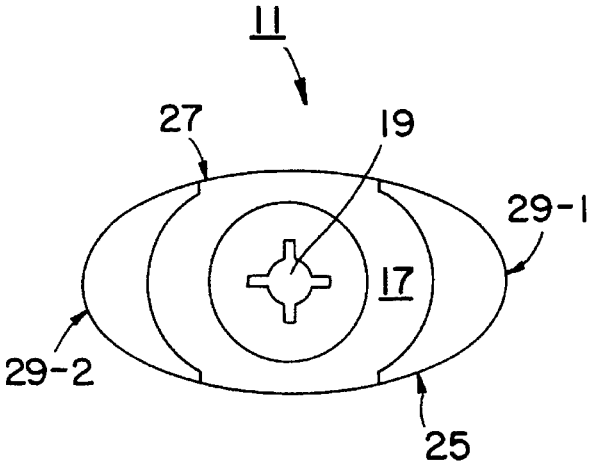
FIG. 4 is a top view of the open-ended article of FIG. 1.

As indicated above, the present invention relates generally to the decoration of open-ended articles with labels of the type that are supported on a moving carrier web. More particularly, the present invention relates to the decoration of round, oval or irregularly-shaped articles with wrap-around, heat-transfer labels of the type that are supported on a moving carrier web.

Referring now to FIGS. 1 through 4, there are shown various views of an illustrative example of an open-ended article that may be decorated in accordance with the teachings of the present invention, the open-ended article being represented generally by reference numeral 11.

Article 11 is a unitary structure preferably made of molded plastic or the like and may be used as a dispensing container for an antiperspirant and/or deodorant stick. Article 11 is shaped to include a thin, slightly-tapered, oval-shaped wall 13, an open end 15 and a closed end 17. Closed end 17 is provided with a small opening 19. Wall 13 is flat in the longitudinal direction from open end 15 to closed end 17 and includes an interior surface 21 and an exterior surface 23. Exterior surface 23 has a front face 25, a rear face 27 and a pair of side faces 29-1 and 29-2. Article 11 may be either rigid or non-rigid in construction.

Figure 5:
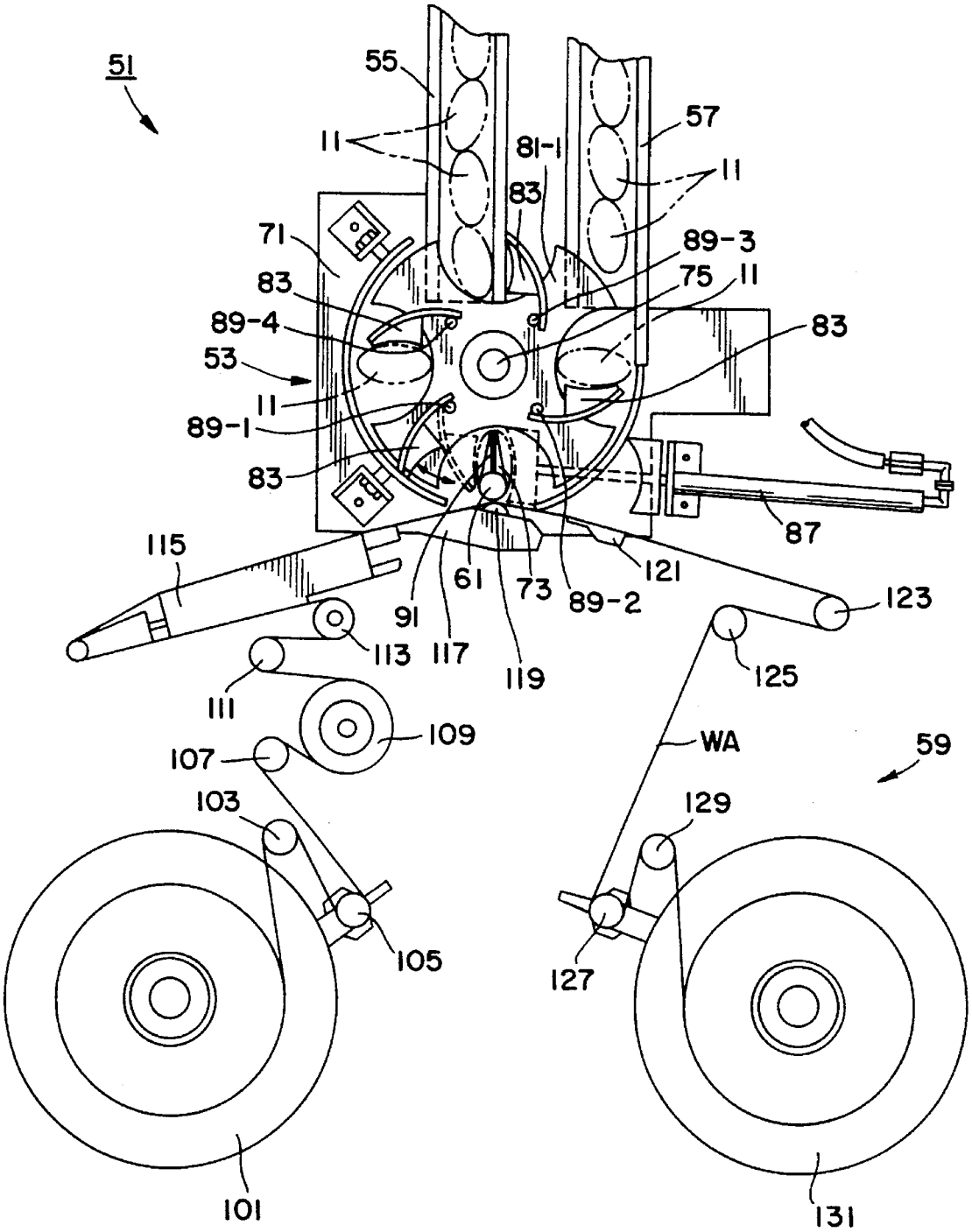
FIG. 5 is a schematic top view of one embodiment of a system for decorating oval-shaped, open-ended articles with wrap-around, heat-transfer labels, the system being constructed according to the teachings of the present invention.

Referring now to FIG. 5, there is shown a schematic top view of one embodiment of a system constructed according to the teachings of the present invention for decorating articles 11 with wrap-around, heat-transfer labels, the system being represented generally by reference numeral 51.

System 51 includes a turret 53 where articles 11 are decorated, a first conveyor 55 for feeding articles 11 to turret 53 for labelling, a second conveyor 57 for removing articles 11 from turret 53 after labelling, and a web transport and label transfer system 59 for moving a web WA containing a plurality of wrap-around, heat-transfer labels into position for label transfer and for transferring positioned labels onto articles 11.

Figure 6:
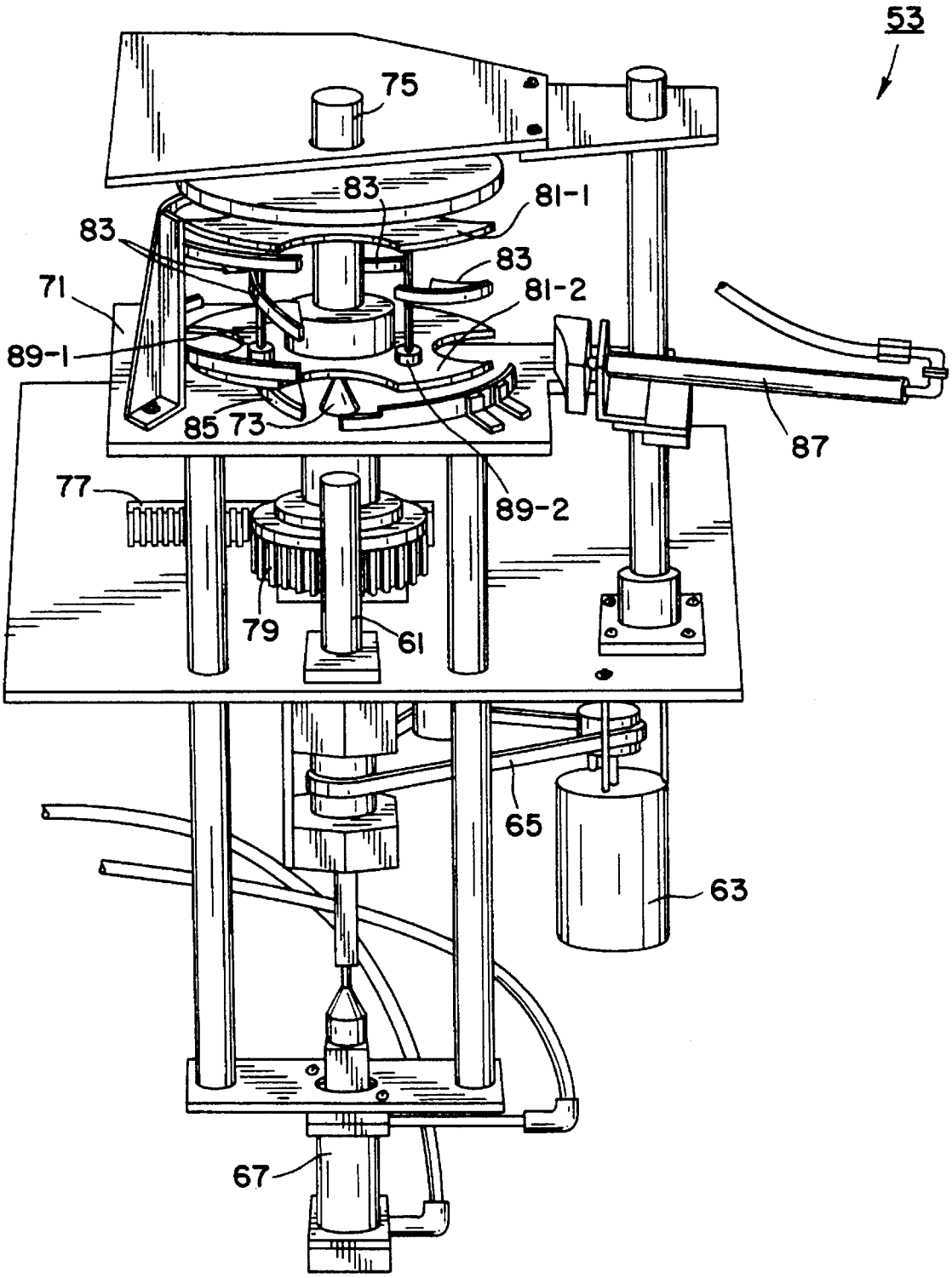
FIG. 6 is a front, top, perspective view of the turret shown in FIG. 5.
Figure 8:
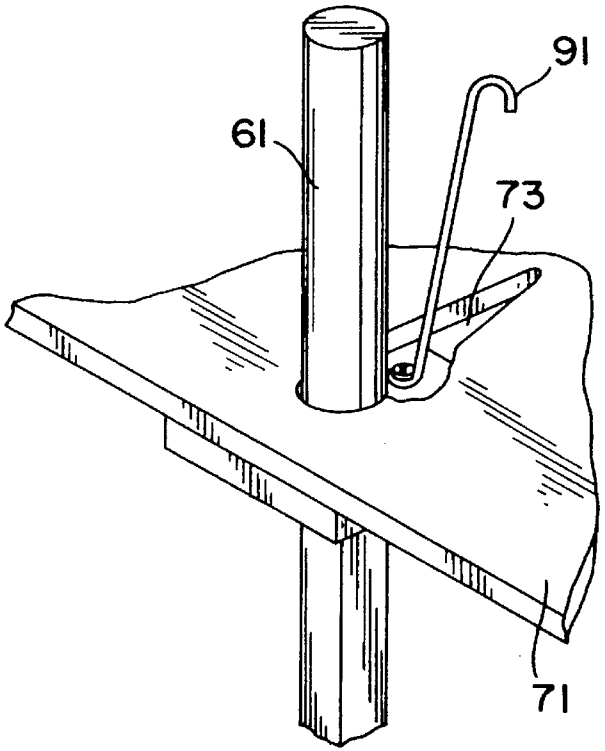
FIG. 8 is an enlarged, fragmentary, perspective view of the turret shown in FIG. 5, showing the rotating mandrel and clip in detail.
Figure 7:
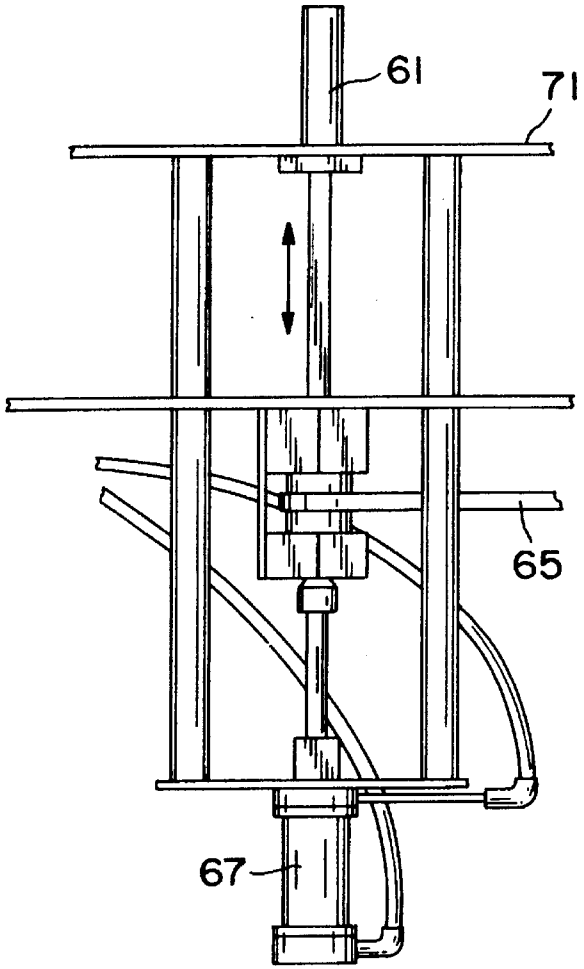
FIG. 7 is a simplified, fragmentary, front view of the turret shown in FIG. 5, illustrating the vertical mobility of the rotating mandrel.

Turret 53, which is also shown in FIGS. 6 through 8, includes a rotatable, vertically movable, translationally-stationary mandrel 61. Mandrel 61 is appropriately sized and shaped to be inserted into article 11 through open end 15 and to follow the circumferential contour of interior surface 21 when article 11 is rolled about mandrel 61 in the manner to be described below. Mandrel 61 is preferably made of or sheathed in rubber or a similar material for frictionally engaging interior surface 21 in such a way as to permit article 11 to roll and/or be driven about mandrel 61.

Turret 53 also includes means for continuously rotating mandrel 61 at an angular velocity such that the surface speed of mandrel 61 matches that of web WA. In the present embodiment, said means for continuously rotating mandrel 61 comprises a motor 63, motor 63 being coupled to mandrel 61 by a belt 65.

Turret 53 also includes means for moving mandrel 61 up and down for insertion into and removal from, respectively, an article 11 positioned thereover. In the present embodiment, said means comprises an air cylinder 67 mechanically coupled to mandrel 61.

Turret 53 also includes a platform 71 onto which unlabelled articles 11 are loaded and from which labelled articles 11 are unloaded. Articles 11 are sequentially labelled on 71 platform at a labelling location. A small opening 73 is provided in platform 71 at the labelling location so that, when an article 11 is positioned over opening 73 at the labelling location, mandrel 61 may be inserted up through opening 73 in platform 71 and into article 11.

Turret 53 also includes a rotatable central shaft 75, shaft 75 extending transversely through platform 71. Rotation of shaft 75 is driven by a rack 77 and a pinion 79. A pair of parallel starwheels 81-1 and 81-2, which are used to transport four articles 11, one at a time, to and away from the labelling location, are fixedly mounted on shaft 75.

Turret 53 also includes registration means for properly orienting an article 11 at the labelling location immediately before labelling. (For purposes of system 51, proper orientation of article 11 requires that side face 29-2 of exterior surface 23 be facing towards the label transfer roller of web transport and label transfer system 59.) In the present embodiment, said registration means includes four upper gripper fingers 83, four lower gripper fingers 85 and a pneumatic guide 87. The respective sets of gripper fingers 83 and 85 are vertically aligned with one another and are mounted on a set of posts 89-1 through 89-4, which are mechanically coupled to starwheels 81-1 and 81-2. Gripper fingers 83 and 85 are positioned relative to starwheels 81-1 and 81-2 so as to releasably engage the back face 27 of an article 11, the release of engagement between fingers 83 and 85 and its associated article 11 immediately before labelling being driven by a cam (not shown). Pneumatic guide 87, which is translationally movable in the manner indicated by the dotted lines in FIG. 5, engages the front face 25 of article 11 when it arrives at the labelling location until immediately before labelling.

Turret 53 further includes a spring 91 which is positioned behind mandrel 61 and which is mechanically coupled to mandrel 61 for vertical movement therewith. Spring 91, which is also insertable into article 11, serves to keep the interior surface 21 of article 11 in contact with mandrel 61 during label transfer by exerting tension against the rear portion of interior surface 21.

Referring back now to FIG. 5, web transport and label transfer system 59 includes a feed reel 101 for holding a web WA of labels (preferably wrap-around, heat-transfer labels). From feed reel 101, web WA passes around an idler roller 103, a dancer roller 105, an idler roller 107, a metering roller 109, a shuttle roller 111, an idler roller 113, and across a label preheater 115. From label preheater 115, web WA passes over a heater/platen 117 and around a label transfer roller 119. Label transfer roller 119 is translationally-movable towards and away from the labelling location on platform 71. From transfer roller 119, web WA travels across a web guide bar 121, around a shuttle roller 123, an idler roller 125, a dancer roller 127, and an idler roller 129, and on to a rewind spool 131. Takeup reel 131 is driven by a motor (not shown). System 59 does not continuously transport web WA but does move web WA during label transfer.

To decorate articles 11 with wrap-around, heat-transfer labels using system 51, one first places the articles 11 to be decorated on conveyor 55 and feeds a web WA carrying the wrap-around, heat-transfer labels through system 59. Once system 51 is activated, the articles 11 are then positioned, one at a time, by starwheels 81-1 and 81-2 over opening 73 in platform 71. With gripper fingers 83 and 85 already engaging rear face 27 of article 11, pneumatic guide 87 then engages front face 25 of article 11. Continuously rotating mandrel 61 then comes up through opening 73 in platform 71 and enters article 11 through its open end 15. At this point in time, mandrel 61 is adjacent to, but not yet engaged with, the interior surface 21 of article 11. Next, transfer roller 119 moves translationally towards mandrel 61 and pushes a heat-transfer label from web WA into contact with side face 29-2 of exterior surface 23 of article 11, thereby initiating its transfer to article 11. At the same time, the pressure exerted by transfer roller 119 and web WA against exterior surface 23 article 11 causes interior surface 21 of article 11 to engage mandrel 61. As a result of its engagement with mandrel 61, article 11 begins to roll around mandrel 61, thereafter bringing, in order, side face 29-2, front face 25, side face 29-1, rear face 27, and side face 29-2 (again) of exterior surface 23 into contact with moving web WA. As the moving web WA contacts exterior surface 23 of article 11, the heat-transfer label carried on the web WA is transferred onto exterior surface 23. At the completion of label transfer, transfer roller 119 moves web WA out of contact with article 11, and mandrel 61 is withdrawn from article 11 and opening 73. Article 11 is then transferred by starwheels 81-1 and 81-2 to conveyor 57.

As mentioned above, one important feature of the label application technique employed by system 51 is that the surface speed of article 11 is maintained at a constant over the entire circumference of article 11.

As can readily be appreciated, one could adapt system 51 for applying wraparound, heat-transfer labels to round, open-ended articles by eliminating gripper fingers 83 and 85 and by changing the shape of pneumatic guide 87 to conform to a round exterior surface. Similarly, one could adapt system 51 for applying wrap-around, heat-transfer labels to more sharply-tapered open-ended articles by, among other things, providing means for tipping the article during label transfer.

The embodiments of the present invention recited herein are intended to be merely exemplary and those skilled in the art will be able to make numerous variations and modifications to it without departing from the spirit of the present invention. For example, it is to be understood that mandrel 61 need not be rotatably driven by a motor, but rather, may be freely rotatable. In this manner, the article being decorated would roll around the mandrel solely as a result of the pressure applied by the label web. Accordingly, in such a case, the surface speed of the article would dictated by the speed of the label web. All such variations and modifications are intended to be within the scope of the present invention as defined by the claims appended hereto.

What is claimed is:

1. A method for decorating an open-ended article with a label supported on a moving carrier web, said method comprising the steps of:

(a) providing a rotatable mandrel, said rotatable mandrel being appropriately sized and shaped to be inserted into the open-ended article through the open end thereof and to follow the contour of the interior surface of the open-ended article when the open-ended article is rolled about said rotatable mandrel;

(b) inserting said rotatable mandrel through the open end of the open-ended article; and (c) transferring a label from the moving carrier web to the exterior of the open-ended article, the label, during transfer, pressing the interior surface of the open-ended article into engagement with said rotatable mandrel in such a way as to cause the open-ended article to roll about the rotatable mandrel.

2. The method as claimed in claim 1 wherein the open-ended article is oval in cross-section.

3. The method as claimed in claim 1 wherein the open-ended article is circular in cross-section.

4. The method as claimed in claim 1 wherein the open-ended article is non-tapered in cross-section.

5. The method as claimed in claim 1 wherein the label is a heat-transfer label.

6. The method as claimed in claim 1 wherein the label is a wrap-around label.

7. The method as claimed in claim 6 wherein the label is a wrap-around, heat-transfer label.

8. An assembly for decorating an open-ended article with a label supported on a moving carrier web, said assembly comprising:

(a) a rotatable mandrel, said rotatable mandrel being appropriately sized and shaped to be inserted into the open-ended article through the open end thereof and to follow the contour of the interior surface of the open-ended article when the open-ended article is rolled about said rotatable mandrel; and (b) means for transferring a label from the moving carrier web to the exterior of the open-ended article, the label, during transfer, pressing the interior surface of the open-ended article into engagement with said rotatable mandrel in such a way as to cause the open-ended article to roll about the rotatable mandrel.

9. The assembly as claimed in claim 8 further comprising means for continuously rotating said rotatable mandrel.

10. The assembly as claimed in claim 9 wherein the surface speed of said rotatable mandrel matches that of the moving carrier web.

11. The assembly as claimed in claim 8 further comprising means for removably inserting said rotatable mandrel into the open-ended article.

12. A system for decorating an open-ended article with a label supported on a carrier web, said system comprising:

(a) a turret for positioning the open-ended article at a transfer location, said turret comprising a rotatable mandrel, said rotatable mandrel being appropriately sized and shaped to be inserted into the open-ended article through the open end thereof and to follow the contour of the interior surface of the open-ended article when the open-ended article is rolled about said rotatable mandrel;

(b) a feed mechanism for positioning the label on the carrier web at the transfer location;

(c) means for transferring a label from the carrier web to the exterior of the open-ended article, the label, during transfer, pressing the interior surface of the open-ended article into engagement with said rotatable mandrel in such a way as to cause the open-ended article to roll about the rotatable mandrel; and (d) conveyor means for feeding the open-ended article to the turret before labelling and for removing the open-ended article from the turret after labelling.

13. The system as claimed in claim 12 wherein said turret further comprises means for continuously rotating said rotatable mandrel.

14. The system as claimed in claim 12 wherein said turret further comprises means for removably inserting said rotatable mandrel into the open-ended article.

15. The system as claimed in claim 12 wherein said turret further comprises a platform onto which unlabelled open-ended articles are loaded and from which unlabelled open-ended articles are unloaded, said platform having an opening at a transfer location, said opening being appropriately sized for removable insertion of said rotatable mandrel therethrough.

16. The system as claimed in claim 15 wherein said turret further comprises means for transporting open-ended articles on said platform, one at a time, to the transfer location.

17. The system as claimed in claim 16 wherein said turret further comprises means for properly orienting an open-ended article at the transfer location immediately before labelling.

* * * * *